US008864523B2

(12) United States Patent
Banakis et al.

(10) Patent No.: US 8,864,523 B2
(45) Date of Patent: Oct. 21, 2014

(54) SHIELDED CONNECTOR

(75) Inventors: Emanuel G. Banakis, Naperville, IL (US); Jerry D. Kachlic, Glen Ellyn, IL (US)

(73) Assignee: Molex Incorporated, Lisle, IL (US)

( * ) Notice: Subject to any disclaimer, the term of this patent is extended or adjusted under 35 U.S.C. 154(b) by 121 days.

(21) Appl. No.: 13/503,911

(22) PCT Filed: Oct. 26, 2010

(86) PCT No.: PCT/US2010/054114

§ 371 (c)(1), (2), (4) Date: Jun. 27, 2012

(87) PCT Pub. No.: WO2011/056584

PCT Pub. Date: May 12, 2011

(65) Prior Publication Data

US 2012/0264330 A1 Oct. 18, 2012

Related U.S. Application Data

(60) Provisional application No. 61/255,072, filed on Oct. 26, 2009.

(51) Int. Cl.

| | |
|---|---|
| ***H01R 13/648*** | (2006.01) |
| ***H01R 12/72*** | (2011.01) |
| ***H01R 13/6585*** | (2011.01) |

(52) U.S. Cl.

CPC ..... *H01R 12/724* (2013.01); *H01R 13/6585* (2013.01)

USPC ..... 439/607.25

(58) Field of Classification Search

USPC ..... 439/607.25, 541.5, 939, 717, 540.1, 439/701, 607.05, 607.06, 607.14, 607.23, 439/607.27, 607.28, 607.32, 607.36, 439/607.37, 607.4, 607.55, 620.16, 95

See application file for complete search history.

(56) References Cited

U.S. PATENT DOCUMENTS

| | | | | |
|---|---|---|---|---|
| 6,074,218 | A * | 6/2000 | Wu et al. | 439/63 |
| 6,086,420 | A | 7/2000 | Wu | |
| 6,149,444 | A * | 11/2000 | Shi et al. | 439/95 |
| 6,234,841 | B1 * | 5/2001 | Chang et al. | 439/607.25 |
| 7,070,446 | B2 | 7/2006 | Henry et al. | |
| 7,249,966 | B2 | 7/2007 | Long | |
| 7,764,504 | B2 | 7/2010 | Phillips et al. | |
| 7,845,975 | B2 | 12/2010 | Cheng et al. | |
| 2002/0048992 | A1 * | 4/2002 | Wang et al. | 439/607 |
| 2003/0228799 | A1 | 12/2003 | Machado et al. | |

FOREIGN PATENT DOCUMENTS

| | | |
|---|---|---|
| JP | 2004-087486 | 3/2004 |
| WO | WO 2008/077133 A1 | 6/2008 |

OTHER PUBLICATIONS

International Search Report for PCT/US2010/054114.

* cited by examiner

*Primary Examiner* — Renee Luebke
*Assistant Examiner* — Harshad Patel
(74) *Attorney, Agent, or Firm* — Stephen L. Sheldon

(57) ABSTRACT

A connector includes a multi-port shield configured to reduce EMI. A housing is positioned inside the shield and includes one or more projections extending from a first face, the projections aligned with each port. A vertical wall is provided on the first face of the housing. Apertures in the vertical wall are aligned with the projections. The vertical wall helps reduce the amount of EMI generated by the connector.

8 Claims, 9 Drawing Sheets

SHIELDED CONNECTOR

This application claims priority to U.S. Provisional App. No. 61/255,072, filed Oct. 26, 2009 and to U.S. Provisional App. No. 61/255,366, filed Oct. 27, 2009, both of which are incorporated herein by reference in their entirety.

BACKGROUND OF THE INVENTION

1. Field of the Invention

The present invention relates to the field of connectors, more specifically to the field of high data rate capable I/O connectors.

2. Description of Related Art

Shielded connectors have been used in external applications (e.g., applications in which the connector acts as an interface external to the system in which it is mounted) so as to provide acceptable electromagnetic interference (EMI) and signal performance. One issue that has been noted is that as the frequencies of signaling increase, additional power is often required in order for the system to function over a similar distance. Furthermore, the use of higher signaling frequencies tends to increase the sensitivity of the connector to external noises in those higher frequencies. In addition, the terminals in the connector tend to act as radiators and emit EMI. As EMI generally needs to be carefully controlled, shielded connectors face a number of challenging issues. Thus, certain individuals would appreciate improvements in shielded connector designs.

BRIEF SUMMARY OF THE INVENTION

A connector includes cage that extends around two three sides and a top and includes a u-brace that defines a first and second port in a front face of the connector. The first and second port both extend from the front face to separate a projection in a housing that is mounted inside the connector. A vertical wall may be positioned on both projections and be configured so that it engages the cage on three sides. The u-brace may include a first and second wall and a folded section may be positioned on both the first and second wall adjacent the front face. A center plug can be positioned between the two folded sections so as to provide good electrical isolation. In an embodiment, both the vertical wall and the folded section features can both be included in connector. In another embodiment, just one of these features can be included in the connector.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
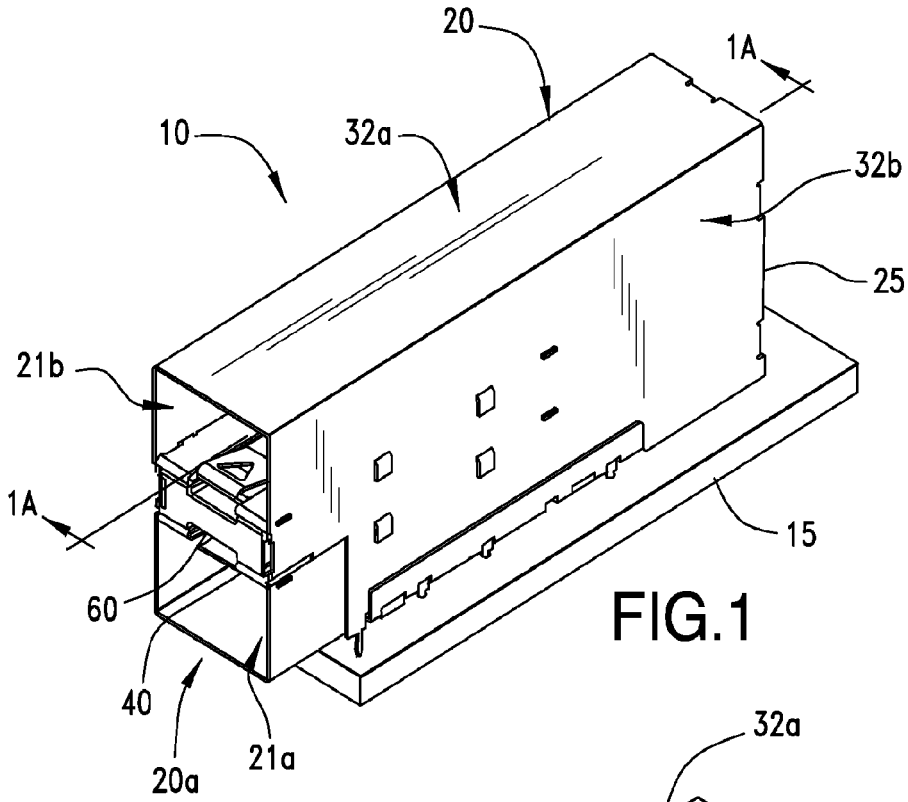
FIG. 1 illustrates a perspective view of an embodiment of a receptacle.
Figure 1A:
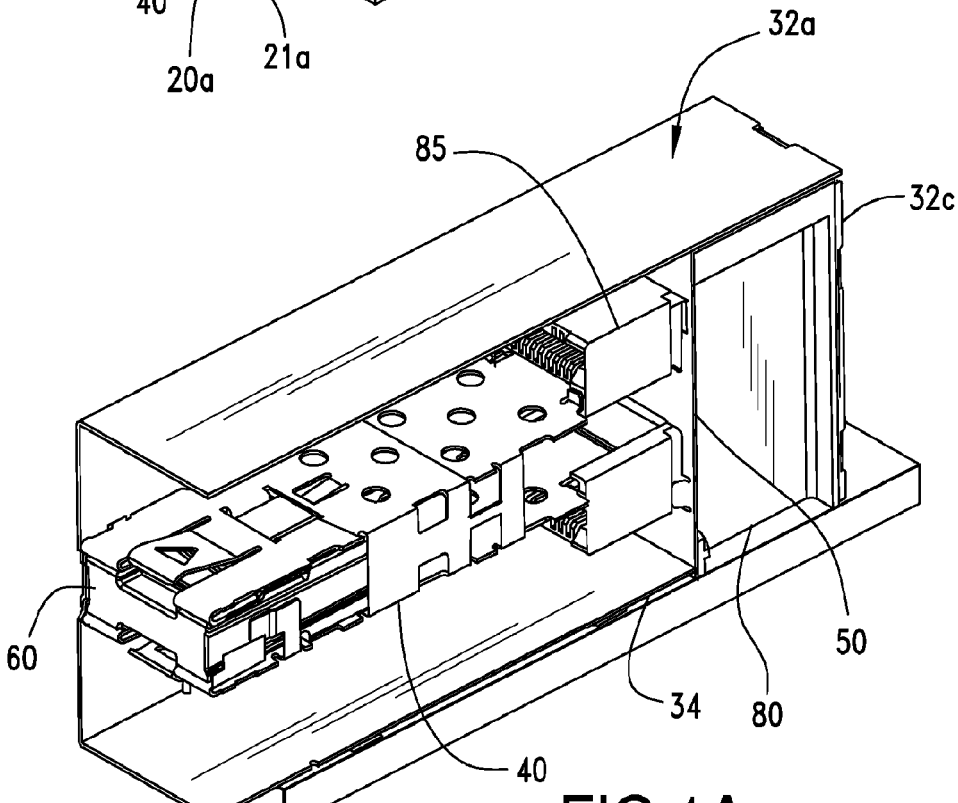
FIG. 1A illustrates a perspective view of a cross-section of the receptacle depicted in FIG. 1.
Figure 1B:
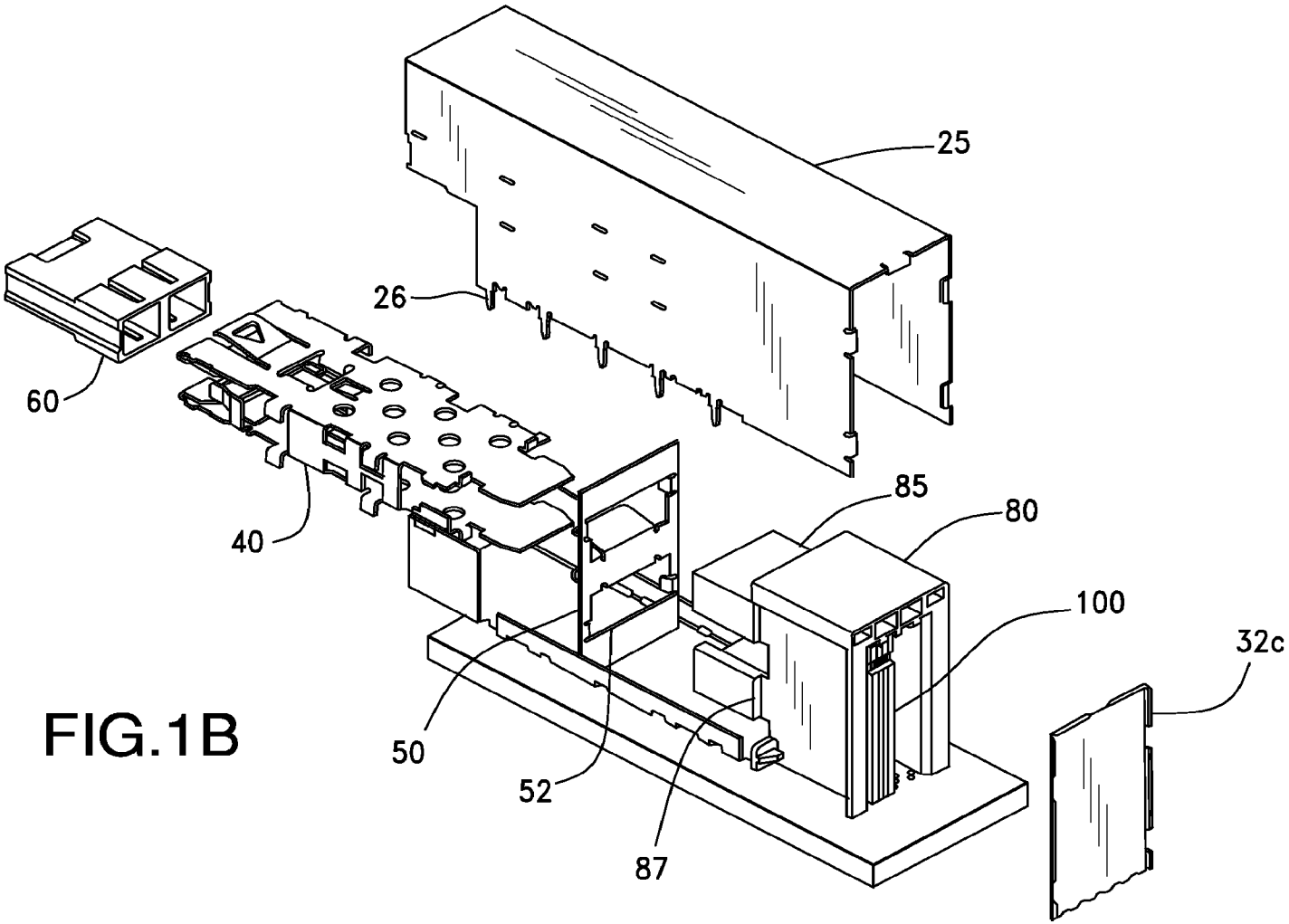
FIG. 1B illustrates an exploded perspective view of the receptacle depicted in FIG. 1.
Figure 2:
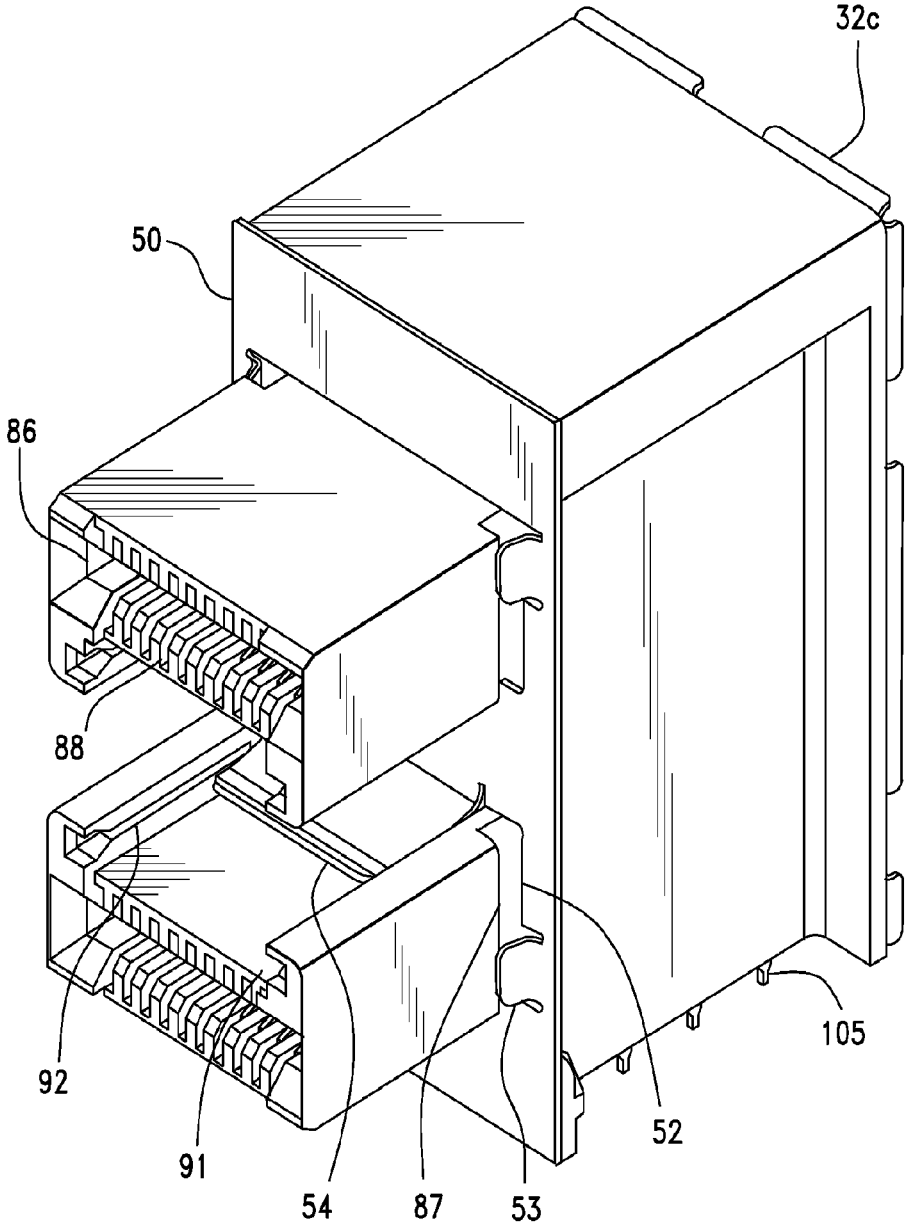
FIG. 2 illustrates a perspective view of an embodiment of a housing with a vertical wall.
Figure 3:
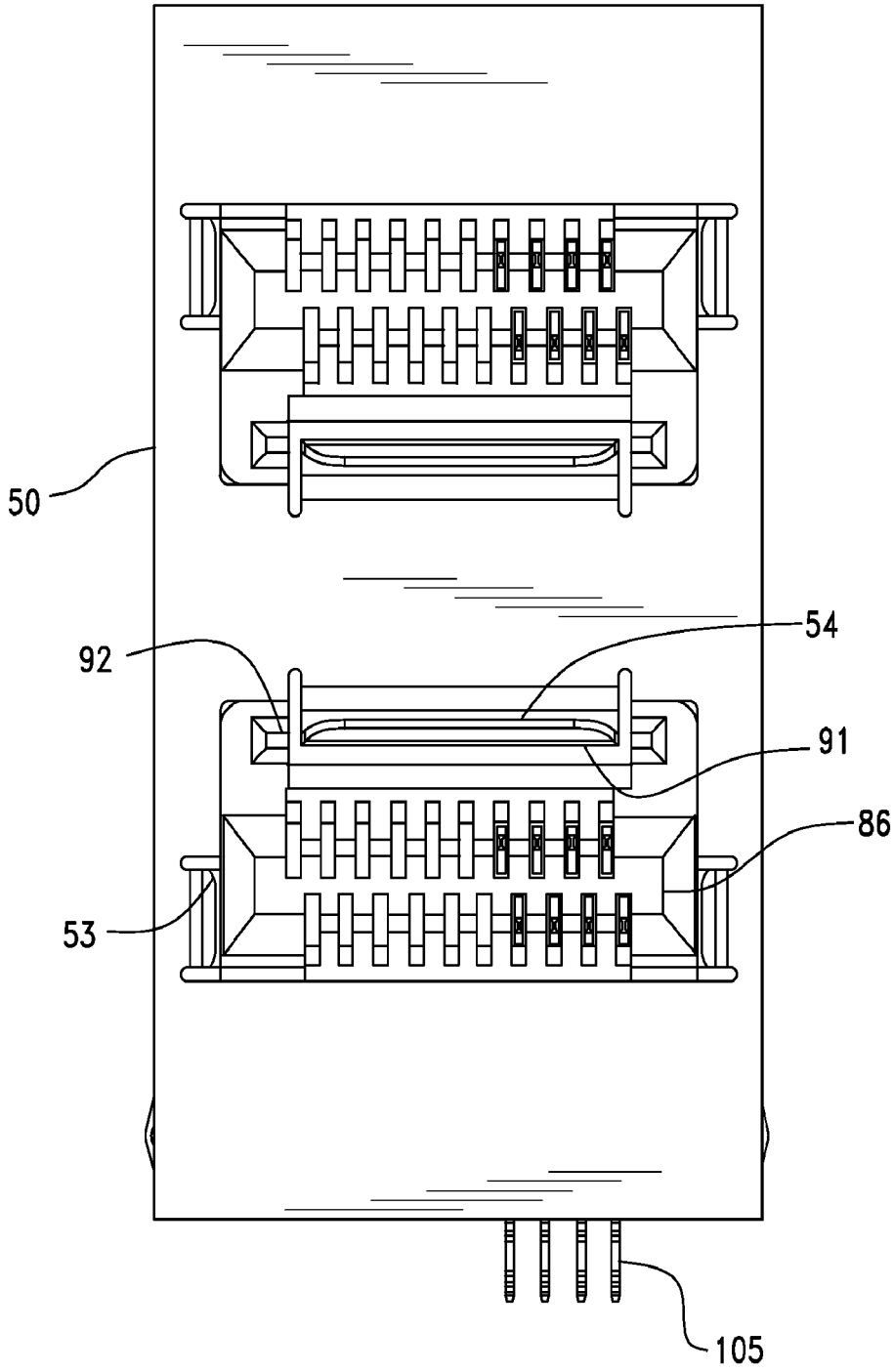
FIG. 3 illustrates an elevated front view of the housing depicted in FIG. 2.
Figure 4:
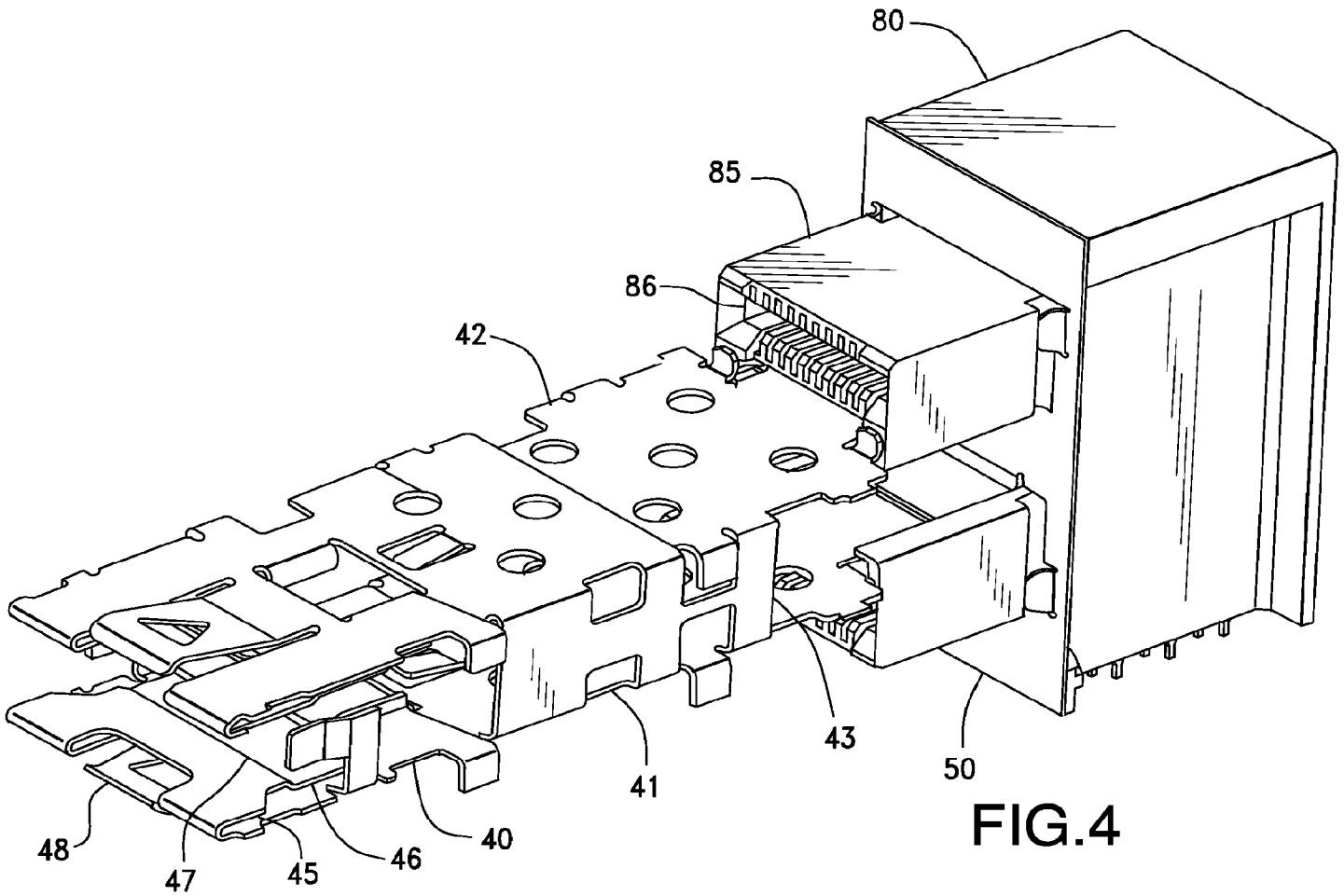
FIG. 4 illustrates a perspective view of an embodiment of a housing and a U-brace.
Figure 4A:
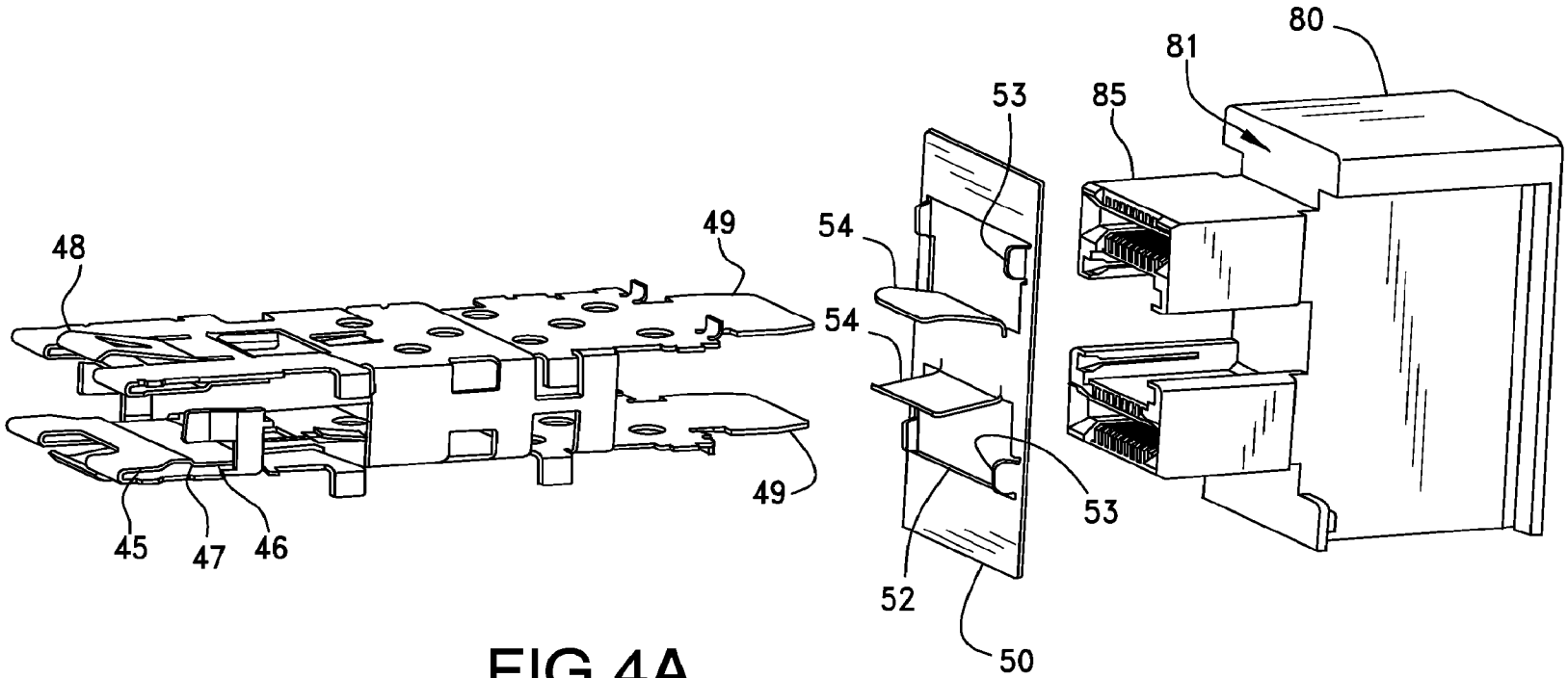
FIG. 4A illustrates a partially exploded view of the embodiment picked in FIG. 4.
Figure 5:
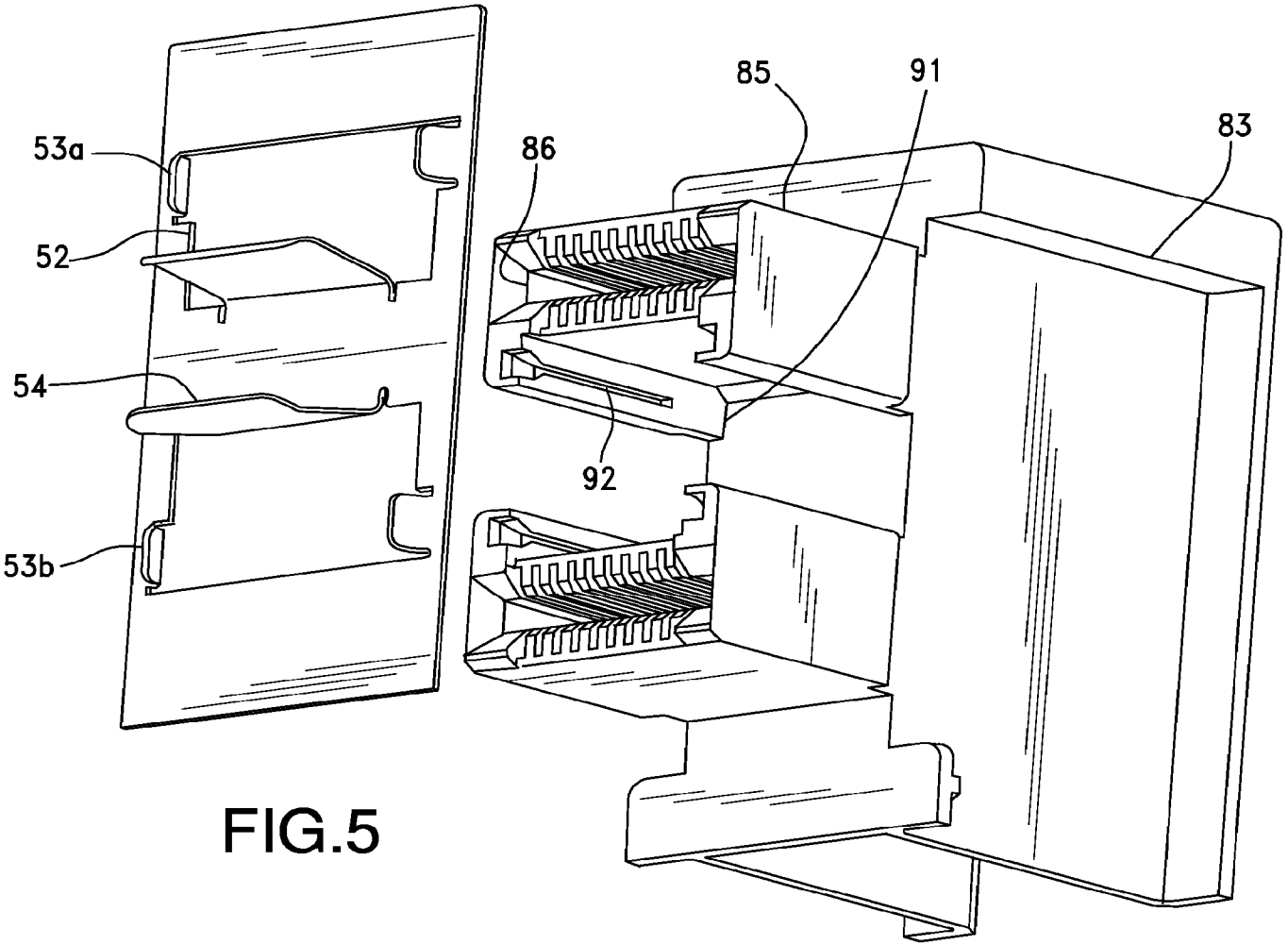
FIG. 5 illustrates a perspective exploded view of an embodiment of a housing and a vertical wall.
Figure 6:
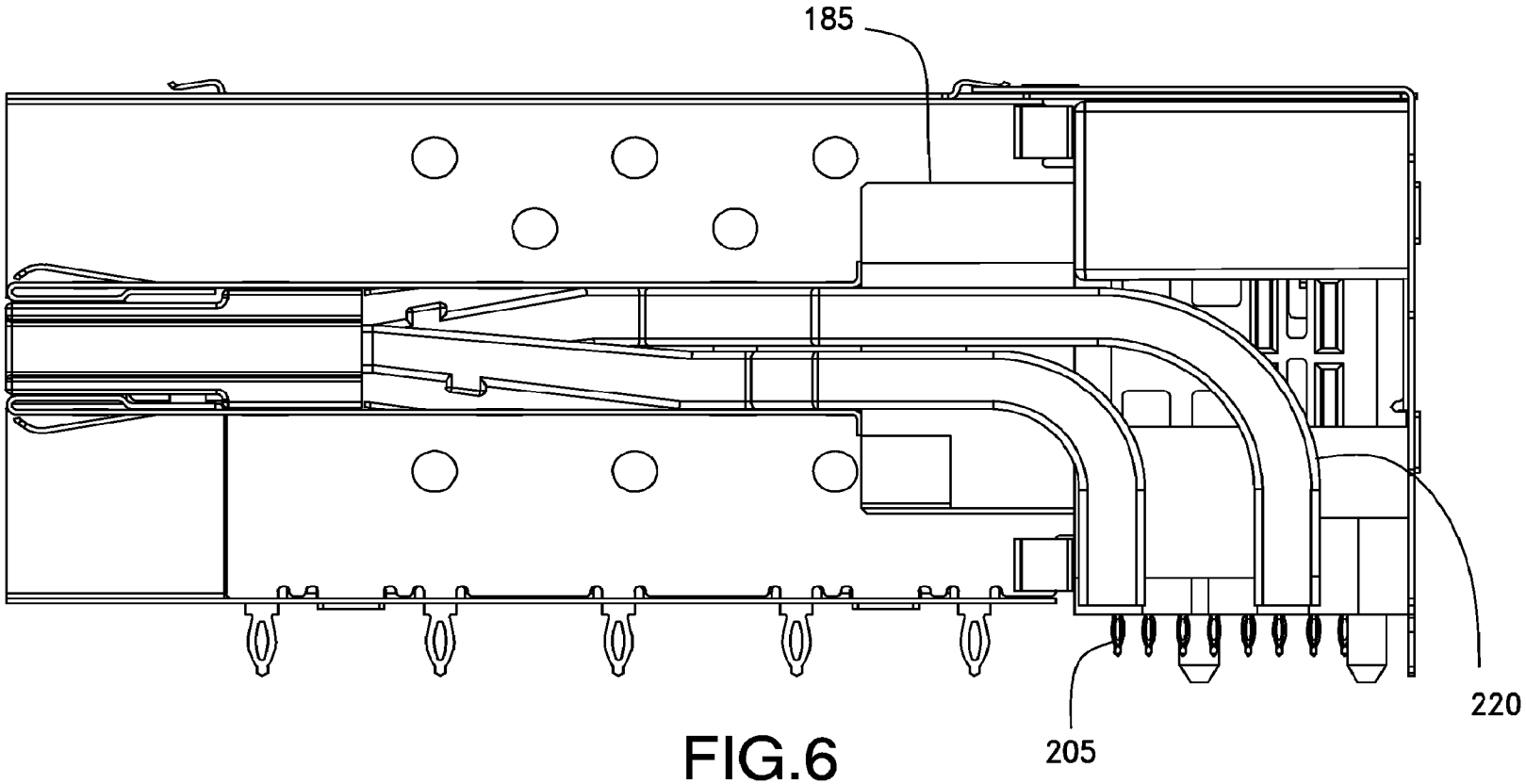
FIG. 6 illustrates elevated side view of a cross-section of the receptacle depicted in FIG. 1.
Figure 7:
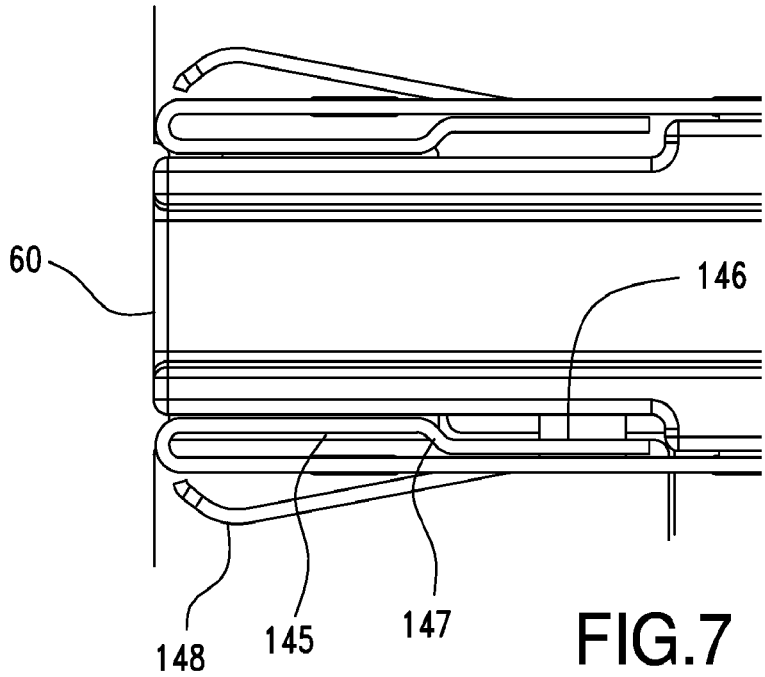
FIG. 7 illustrates an enlarged elevated side view of the cross-section depicted in FIG. 6.
Figure 8:
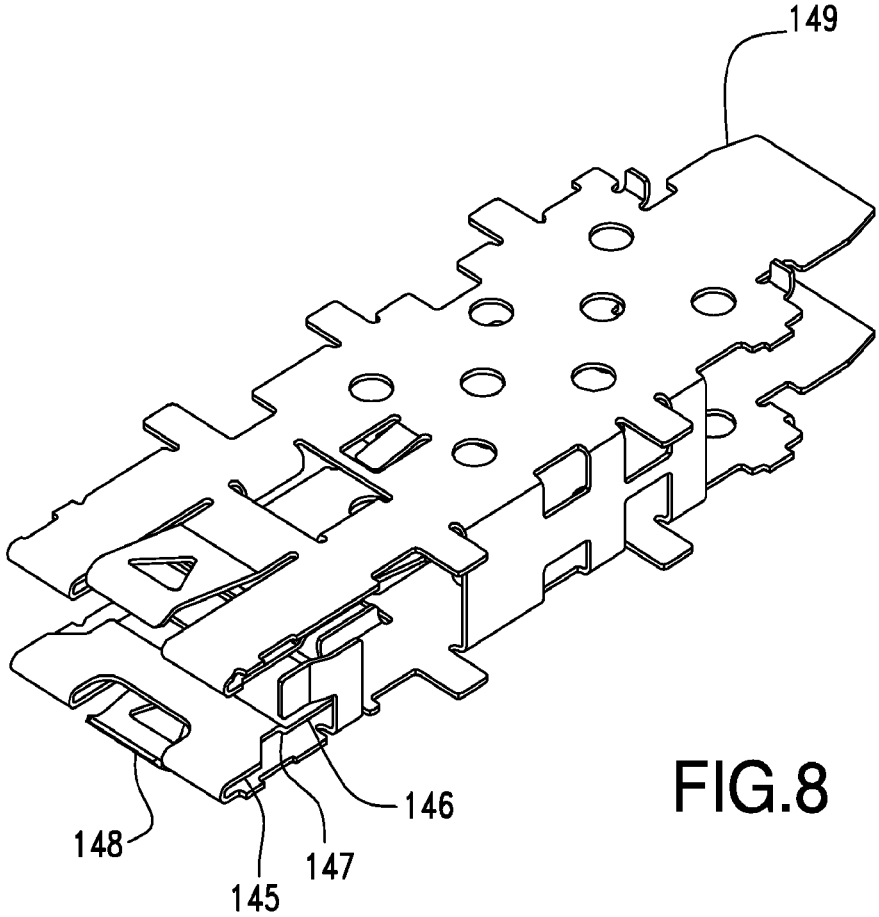
FIG. 8 illustrates a perspective view of an embodiment of a U-brace.

FIGS. 1-8 illustrate various features that may be incorporated into a connector 10 that is mounted on a printed circuit board (PCB) 15. As can be appreciated, the connector 10 includes a cage 20 that includes a cover 25, a bottom plate 34 and a u-brace 40 that helps define a first port 21*a* and a second port 21*b*. The cage includes a top wall 32*a*, a side wall 32*b* and a rear wall 32*c* and a front face 20*a*. The connector 10 thus depicts a stacked connector configuration.

As can be appreciated, one issue that exists in such designs is the desire to shield from external signals and noise while minimizing the emission of EMI from the connector 10. To help improve the ability of the cage 20 to isolate and act as a shield, a vertical wall 50 is positioned near a first face 81 of a housing 80. The vertical wall 50 has an aperture 52 that mounts over projection 85 (each projection including one or more card slots) so that the vertical wall 50 can be positioned on or close to the front face and retention tabs 53 engage notch 87 of the housing 80. This helps prevent spurious signals (e.g., noise) from entering and interfering with signals carried over terminals 105 in the connecter 10 as well as reducing the radiating of spurious signals (e.g., EMI) from the terminals. To further improve the shielding, the vertical wall 50 can include a flange 54 that engages shoulder 49 of the u-brace 40. Thus, in an embodiment there is a substantially continuous enclosure for each port 21*a*, 21*b*. It should be noted that the vertical wall flange 54 is positioned in a channel 91 while the shoulder 49 is positioned in groove 92. This type of construction helps ensure the flange 54 securely engages the shoulder 49.

For certain designs the vertical wall 50 may not be necessary and improvements in shielding can be accomplished by improving shielding at the front face 20*a* of the cage 20. The u-brace 40 may also include a folded section 45 to help shield each port 21*a*, 21*b*. The folded section 45 is configured to engage center plug 60, which may be formed in a manner so as to act as a shield (e.g., the center plug may be formed of a metal). The center plug 60 is positioned between two folded sections 45 so that an EMI shield is formed therebetween. To help support the folded section 45, a lip 46 can rest against wall 41, 42 and an angled section 47 can be positioned between the lip 46 and the folded section 45. As depicted, the folded section extends substantially the entire width of the port. Consequentially, when the center plug 60 is inserted between the upper and lower folded sections it forms a substantially continuous shield.

While either the vertical wall or the u-brace may be used individually, in an embodiment, both the vertical wall 50 and the u-brace 50 with the folded section 45 may be included in the same connector. Such a combination has the benefit of using the vertical wall 50 to reduce the EMI energy that is transmitted into the port from the housing (and the associated terminals 105 which may be positioned in wafers, as is known, if the terminals are in a stacked configuration as depicted) while ensuring good electrical connection between an inserted plug module (not shown) and walls 41, 42 of the individual ports. Furthermore, the folded sections act to further reduce the amount of EMI energy transmitted out of the port.

It should be noted that light pipes 220 can also be included. If the light pipes are included in combination with the vertical wall 50, then apertures can be provided in the vertical wall 50 so that the light pipes can pass between a supporting circuit board and the front face 20*a* of the connector 10. Furthermore, the center plug 60 can also include apertures or areas configured to transmit light emitted from the light pipes.

As depicted, a single stacked connector is illustrated with a single vertical wall. It is also contemplated that the vertical wall could be made into two or more parts. As can be further appreciated, in a ganged connector configuration a single vertical wall could be used with each U-brace. However, it is also possible to have a single wall span across multiple housings if the cage was so configured. The depicted arrangement of a vertical wall that spans two stacked ports has the benefit of ensuring good EMI performance without requiring a substantial change to existing cage design.

In addition, to the above discussed features, the number of apertures on walls of the cage 20 can be reduced to reduce the EMI that is transmitted into or out of the connector. For example, as depicted the walls are substantially devoid of apertures. Thus, a number of features that could provide improved shielding are disclosed herein. As can be appreciated, these features can be used in combination with each other so as to provide the desired level of EMI shielding.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a cage having a first and second port;

a housing positioned in the cage and having a first face, the housing having a first projection and a second projection on the first face, the first projection aligned with the first port and the second projection aligned with the second port; and a vertical wall positioned on the first face and configured to be electrically coupled to the cage, the vertical wall having a first aperture aligned with the first projection and a second aperture aligned with the second projection wherein the cage has a top and a bottom and the vertical wall extends substantially between the top and bottom, wherein the connector further includes a u-brace, the u-brace positioned between the first and second projection, wherein the u-brace includes a folded section and wherein the connector includes a plug configured to be inserted into the u-brace, the plug configured to engage the folded section.

2. The connector of claim 1, wherein the vertical wall includes a flange that engages the u-brace.

3. A connector, comprising:

a cage having a top wall, a side wall and a rear wall and a front face, the cage having a first port and a second port in the front face, the ports extending from the front face toward the rear wall;

a housing positioned in the cage adjacent the rear wall and having a first face, the housing having a first projection and a second projection on the first face, the first projection aligned with the first port and the second projection aligned with the second port, wherein the ports extend from the first face toward the front face; and a vertical wall positioned on the first face and configured to be electrically coupled to the cage, the vertical wall having a first aperture aligned with the first projection and a second aperture aligned with the second projection;

and wherein the first and second projections extend through the first and second apertures, respectively, such that the first and second projections extend to a position between the vertical wall and the front face.

4. The connector of claim 3, wherein the ports are partially defined by the side wall.

5. The connector of claim 3, further comprising a u-brace positioned between the first and second ports.

6. The connector of claim 5, further comprising a plug configured to be inserted into the u-brace, the plug aligned with the front face of the cage.

7. The connector of claim 6, further comprising a light pipe configured to direct light from a supporting circuit board toward the front face.

8. The connector of claim 5, wherein the vertical wall includes a flange that engages the u-brace.

* * * * *